US008899159B2

(12) United States Patent
Zanutti et al.

(10) Patent No.: US 8,899,159 B2
(45) Date of Patent: Dec. 2, 2014

(54) SPRING ASSEMBLY FOR LEVEL CONTROL IN A VEHICLE

(75) Inventors: Cedric Zanutti, Sart-Eustache (BE); Michael Wusching, Wilthen (DE); Andreas Wolf, Winterthur (CH)

(73) Assignee: Bombardier Transportation GmbH, Berlin (DE)

( * ) Notice: Subject to any disclaimer, the term of this patent is extended or adjusted under 35 U.S.C. 154(b) by 97 days.

(21) Appl. No.: 13/499,147

(22) PCT Filed: Sep. 22, 2010

(86) PCT No.: PCT/EP2010/063993

§ 371 (c)(1),
(2), (4) Date: Jun. 15, 2012

(87) PCT Pub. No.: WO2011/039092

PCT Pub. Date: Apr. 7, 2011

(65) Prior Publication Data

US 2012/0240818 A1 Sep. 27, 2012

(30) Foreign Application Priority Data

Sep. 30, 2009 (DE) ..... 10 2009 043 488

(51) Int. Cl.

| | |
|---|---|
| ***B61F 5/08*** | (2006.01) |
| ***B61F 5/10*** | (2006.01) |
| ***B61F 5/12*** | (2006.01) |
| ***B61F 5/14*** | (2006.01) |
| ***B61F 5/02*** | (2006.01) |

(52) U.S. Cl.

CPC .... *B61F 5/14* (2013.01); *B61F 5/02* (2013.01)
USPC ..... 105/198.3

(58) Field of Classification Search

USPC ..... 104/197.05, 198.3, 199.1, 199.3; 105/197.05, 198.3, 199.1, 199.3

See application file for complete search history.

(56) References Cited

U.S. PATENT DOCUMENTS

| | | | |
|---|---|---|---|
| 3,580,557 | A | 5/1971 | Dean |
| 5,588,368 | A | 12/1996 | Richter et al. |
| 7,185,592 | B2 | 3/2007 | Hommen et al. |
| 7,520,494 | B2 | 4/2009 | Gaile |
| 2004/0016361 | A1 | 1/2004 | Teichmann et al. |

FOREIGN PATENT DOCUMENTS

| | | | |
|---|---|---|---|
| DE | 1082135 | B | 5/1960 |
| DE | 20105329 | U1 | 6/2001 |
| DE | 10236245 | A1 | 2/2004 |
| DE | 10360518 | A1 | 7/2005 |
| EP | 1391331 | A2 | 2/2004 |
| JP | 7125634 | A | 5/1995 |
| JP | 2005205927 | A | 8/2005 |

*Primary Examiner* — Zachary Kuhfuss
(74) *Attorney, Agent, or Firm* — The Webb Law Firm

(57) ABSTRACT

Disclosed is a spring assembly for level controlled support of a wagon body on a running gear of a vehicle, in particular of a railway vehicle, including a spring device and an actuator device, wherein the spring device takes up a first installation space, the actuator device takes up a second installation space, the spring device and the actuator device are connected to each other in a direction of action in a kinematically serial arrangement, and the actuator device is designed for at least partially compensating for a change in length of the spring device in the direction of action by a displacement at an actuator component in the direction of action, and wherein the first installation space and the second installation space overlap each other in the direction of action in an overlapping region. Also disclosed is a vehicle having such a spring assembly.

12 Claims, 4 Drawing Sheets

SPRING ASSEMBLY FOR LEVEL CONTROL IN A VEHICLE

BACKGROUND OF THE INVENTION

1. Field of the Invention

The present invention relates to a spring assembly for level controlling support of a wagon body on a running gear of a vehicle, in particular of a railway vehicle, comprising a spring device and an actuator device. The spring device takes up a first installation space, while the actuator device takes up a second installation space. The spring device and the actuator device are connected to each other in a direction of action in a kinematically serial arrangement, wherein the actuator device is designed for at least partially compensating for a change in length of the spring device in the direction of action by a displacement at an actuator component in the direction of action. The present invention also relates to a vehicle having such a level-controlling spring assembly.

2. Description of the Related Art

In railway vehicles (but also in other vehicles) the wagon body is usually resiliently mounted with respect to the wheel units (e.g. single wheels, pairs of wheels or wheelsets) by way of one or a plurality of spring stages. Differing degrees of deflection of the springs in these spring stages occur over time depending on the loading of the railway vehicle. With a purely passive system or without appropriate countermeasures this leads, by way of example, to the passengers having to negotiate a more or less high step upon boarding or exiting when the railway vehicle stops at platforms with a certain, constructionally predetermined platform level above the top edges of the rail (which define the reference level). Boarding and/or exiting can potentially be made considerably more difficult hereby, especially for passengers with physical limitations. A further cause, in addition to varying loading, of such an undesirable step when boarding and/or exiting lies, moreover, in the wear occurring over time on the wheels of the wheel units.

Different approaches are taken in known vehicles with active systems to counteract this problem. In conventional vehicles with a secondary suspension comprising pneumatic springs the level of the wagon body can, by way of example, be easily controlled by way of appropriate adjustment of the pneumatic pressure in the pneumatic springs. However, such pneumatic spring systems have the drawback that, owing to the limited operating pressure (typically at a maximum pressure of about 7 bar), as a rule they take up a relatively large installation space in order to be able to apply the required supporting forces.

An active spring system is also known from DE 103 60 518 B4 in which an actuator of a hydropneumatic actuator device is arranged between the wagon body and a bogie frame to be kinematically parallel to a passive spring (by way of example a conventional helical spring) of the secondary suspension. This actuator can be used to actively adjust the level of the wagon body by exerting (parallel to the supporting force of the passive spring) an appropriate actuating force between the wagon body and the bogie frame.

While the desired level control can be achieved when stopping at platforms using such an active system, there is the problem that level control via the actuator must, as a rule, firstly be switched off during travel in order to achieve the desired spring effect (otherwise a very complex, highly dynamic controller would be necessary for the actuator). Secondly, a malfunction of the actuator, by way of example a blocking, can lead to significant stiffening of the secondary suspension which is highly undesirable with regard to both the derailment safety system and travelling comfort.

Finally, a generic active spring system is known from DE 102 36 245 A1 in which an actuator of an actuator device is arranged between the wagon body and a bogie frame to be above and in a kinematically serial arrangement with respect to a passive spring (e.g. a conventional helical spring) of the secondary suspension. The actuator arranged coaxially to the spring can be used to actively adjust the level of the wagon body in that it compensates a change in the length of the spring (as results by way of example from a change in the loading of the vehicle) by its own appropriate change in length (i.e. a displacement at one of its components).

The desired level control when stopping at platforms as well as during travel can be achieved using this active system. However, there is the problem that the kinematically serial arrangement of spring and actuator results in a large construction, in particular in the height direction of the vehicle, which, with an installation space predetermined for the secondary suspension (as a rule within comparatively narrow limits), can only be integrated in the vehicle with considerable effort without a loss in relation to the vehicle safety and comfort properties (hence with sufficiently low stiffness).

The object underlying the present invention is therefore to provide a spring assembly or a vehicle of the type mentioned in the introduction which does not exhibit said drawbacks, or at least to a lesser extent, and in particular easily and reliably allows integration of level control in a vehicle without significant reductions in the travelling safety and travelling comfort for the passengers.

SUMMARY OF THE INVENTION

The present invention is based on the technical teaching that the integration of a level control in a vehicle without significant reductions in the travelling safety and travelling comfort for the passengers is easily and reliably possible if the spring device and actuator device disposed kinematically in series with each other are arranged such that the installation spaces that they take up overlap at least in their direction of action in an overlapping region. A particularly compact design can be achieved in the direction of action (as a rule the vehicle height direction in which the wagon body is to be primarily supported by the spring assembly) by way of this overlapping without (with the predetermined installation space) the stiffness of the spring assembly being affected to a significant extent due to an noticeable shortening of the spring(s) of the spring assembly.

Depending on the degree of overlapping it is therefore even possible to fit or retrofit a known spring assembly with a spring assembly according to the invention, wherein at least virtually unchanged springs can be used and therefore virtually unchanged spring properties exist.

According to a first aspect the present invention relates therefore to a spring assembly for level controlling support of a wagon body on a running gear of a vehicle, in particular of a railway vehicle, comprising a spring device and an actuator device, wherein the spring device takes up a first installation space, the actuator device takes up a second installation space, the spring device and the actuator device are connected to each other in a direction of action in a kinematically serial arrangement, and the actuator device is designed for at least partially compensating for a change in length of the spring device in the direction of action by a displacement at an actuator component in the direction of action. The first installation space and the second installation space overlap each other in the direction of action in an overlapping region.

Depending on the installation space available for the spring assembly in the respective vehicle the overlapping of the installation spaces can be selected so as to be of different sizes. In preferred variants of the invention the overlapping region has a first dimension in the direction of action, while the spring device, in a nominal operating state, has a second dimension in the direction of action, wherein the first dimension is then at least 20% of the second dimension. A good space saving for the spring assembly in the direction of action can already be made hereby, so integration in the vehicle is simplified. An even greater simplification of integration of the spring assembly in the vehicle results if the first dimension is at least 40% of the second dimension, and preferably at least 60% of the second dimension. Particularly compact designs may be achieved hereby.

It should be mentioned at this point that, within the sense of the present invention, the nominal operating state designates the state of the vehicle with a nominal load or the state of the spring assembly with a nominal load, for which the spring assembly is nominally designed.

The overlapping of the installation spaces may be achieved in several ways. Therefore, in certain variants of the spring assembly according to the invention, it is provided that the spring device comprises at least one spring unit and the actuator device comprises at least one actuator unit, wherein the at least one spring unit and the at least one actuator unit are arranged so as to be nested in each other to produce the overlapping region. The nested arrangement can be achieved, for example, in that an actuator unit is placed in an accordingly designed section of a spring unit, such that, in other words, this section of the spring unit surrounds the actuator unit. It is of course conversely also possible for some of the spring unit to be placed in an appropriately designed section of the actuator unit. It can of course also be provided, for such a nested arrangement, that a plurality of spring units surround one or a plurality of actuator unit(s) in sections (or vice versa).

The spring device preferably comprises at least two spring units while the actuator device comprises at least one actuator unit. The actuator unit is then arranged in an interspace between the at least two spring units to produce the overlapping region. This design is particularly advantageous since it may be employed particularly easily in conjunction with a range of conventional vehicles in which a plurality of adjacent spring units (e.g. two passive springs per running gear side for the secondary suspension) are already used. It is possible here to implement the present invention with virtually unchanged spring units (compared with the previous design) and to arrange the actuator unit simply in the interspace between the two spring units.

The actuator unit can be arranged in the interspace between two or more spring units. Owing to the particularly simple, comparatively small design, variants with just two spring units are preferably implemented, however. The actuator unit is preferably connected to the spring device by at least one coupling device, wherein the coupling device includes a bridge element. The bridge element is connected at a first end to a first spring unit of the spring device, while it is connected at a second end to a second spring unit of the spring device. The bridge element comprises a middle region which bridges an interspace between the first spring unit and the second spring unit, wherein the actuator unit is connected to the bridge element in the middle region. A particularly simple design may be achieved hereby.

The connection between the actuator unit and the spring device can basically be designed in any desired, suitable way. In particular, a substantially rigid connection can be provided between the actuator unit and the spring device. To avoid excessive loads on the actuator unit, in particular on the moving parts of the actuator unit transversely to the direction of action, a decoupling of loads is preferably provided in the region of the actuator unit in these load directions running transversely to the direction of action.

The decoupling can take place in any desired manner. In preferred variants of the spring assembly according to the invention it is provided, for example, that the actuator unit is connected to the spring device by at least one coupling device, wherein the at least one coupling device comprises at least one joint device via which the actuator unit is connected to the spring device so as to be pivotable about at least one decoupling axis. In this case the at least one decoupling axis runs in a plane transverse, in particular perpendicular, to the direction of action, so the decoupling of moments about this decoupling axis is ensured.

In particular in railway vehicles with comparatively large distances between the running gear, significant pitching moments (about a pitch axis running parallel to the vehicle transverse axis) can act on the secondary suspension during travel over crests or through depressions, so in these cases a decoupling of moments about an axis running in the transverse direction of the vehicle is preferably provided. However, it is understood that the decoupling can also be provided about a plurality of axes running transversely or perpendicularly to each other. For this case, the joint device can be designed, for example, in the manner of a ball and socket joint or in the manner of a cardan joint. However, the joint device may also be at least one resilient element which provides the decoupling about the decoupling axis. It can, for example, be one or a plurality of resilient sleeves in which the actuator unit is resiliently mounted.

The spring units and the actuator unit can basically be arranged with respect to each other in any desired suitable way. An arrangement is preferably selected in which the longitudinal axis of the spring units and the actuator unit are arranged so as to be substantially coplanar since this is advantageous with respect to a balanced distribution of the forces and moments within the spring assembly. In this case, decoupling preferably takes place about an axis running transversely to this plane. In preferred variants of the spring assembly the first spring unit defines a first spring axis while the second spring unit defines a second spring axis and the first spring axis and the second spring axis define a spring axis plane. The at least one decoupling axis of the coupling device runs transversely, in particular perpendicularly, to the spring axis plane.

Independently of the number and/or arrangement of the spring units of the spring device, in preferred variants of the spring assembly according to the invention, at least one decoupling region with a decoupling device is provided in the region of the actuator device, wherein the decoupling device provides at least one moment decoupling about at least one moment axis running transversely to the direction of action. The decoupling can be provided in the region of the connection of the actuator device to the spring device (i.e. in the coupling region between the spring device and the actuator device), as has already been described above using the example of specific design variants.

In addition or as an alternative, undesired forces and moments can, however, be decoupled at an other point (than the coupling region between the spring device and the actuator device). In certain variants of the spring assembly according to the invention, the spring device and the actuator device are connected to each other in a coupling region, wherein the decoupling region is arranged at a distance from the coupling region in a force flow direction to provide the decoupling (optionally also) at a point other than the coupling region. The decoupling region is preferably arranged at a distance from the coupling region. This can take place at any desired point in the region of the actuator device. The decoupling region is preferably arranged in an end region of the actuator device that faces away from the coupling region in the force flow direction since decoupling may be achieved comparatively easily in such a connecting region to adjacent components.

The respective decoupling device can basically be implemented by any desired, suitable units. Therefore, one or a plurality of simple swivel or pivot joints may be used. A moment decoupling may be achieved within a particularly compact space if the decoupling device comprises at least one resilient element, in particular a rubber element, for this purpose.

The spring device can basically also be implemented by any desired, suitable elements. Therefore passive pneumatic springs, by way of example, may be used. Owing to the particularly simple and robust design the spring device preferably comprises at least one mechanical spring unit, wherein the spring unit preferably comprises at least one rubber element and/or at least one metal spring.

The actuator device can also be implemented in basically any desired, suitable way using any desired, suitable operating principles (individually or in any desired combination). Therefore, electromechanical actuators (for example conventional spindle drives, etc.) can be used, for example. Owing to the particularly robust and, in the region of the actuator, compact design, the actuator device preferably comprises at least one actuator unit working according to a fluidic operating principle, wherein the actuator device preferably comprises at least one hydraulic actuator unit and/or at least one hydropneumatic actuator unit.

The present invention also relates to a vehicle, in particular a railway vehicle, having a wagon body, a running gear and a spring assembly according to the invention, wherein, for level controlled support of the wagon body on the running gear, the spring assembly is arranged between the wagon body and a component of the running gear, in particular a running gear frame of the running gear. In addition or as an alternative, the spring assembly according to the invention can be arranged between two components of the running gear. It is therefore possible to provide the spring assembly according to the invention in the region of the secondary suspension and in the region of the primary suspension of the vehicle.

To implement automatic level control a controller connected to the actuator device, and a sensor device connected to the controller, is preferably provided, wherein the sensor device is designed for detecting a current value of a detection variable which is representative of a level of the wagon body in the height direction above a reference value of a track that is currently being travelled. The controller is then designed for level-controlling actuation of the actuator device as a function of the current value of the detection variable.

The sensor device can be any desired, suitable device which works according to any desired operating principle. In particular, contactlessly operating sensors may be provided.

BRIEF DESCRIPTION OF THE DRAWINGS

Further preferred embodiments of the invention become apparent from the dependent claims and the following description of preferred embodiments which refer to the accompanying drawings. It is shown in:

DESCRIPTION OF THE PREFERRED EMBODIMENT

First Embodiment

Figure 1:
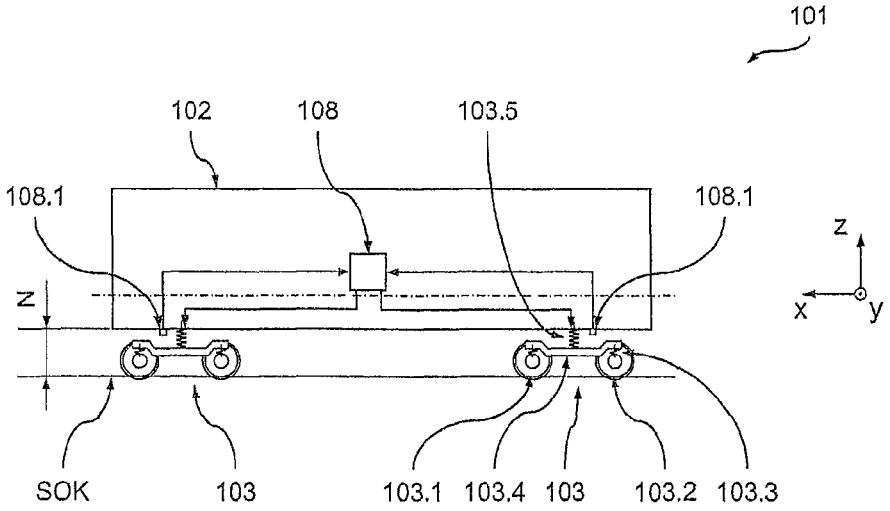
FIG. 1 a schematic side view of a preferred embodiment of the vehicle according to the invention with a preferred embodiment of the spring assembly according to the invention, FIG. 2 a schematic perspective view of the spring assembly from FIG. 1, FIG. 3 a schematic side view of the spring assembly from FIG. 2, FIG. 4 a schematic section of a further preferred embodiment of the spring assembly according to the invention, FIG. 5 a schematic section of a further preferred embodiment of the spring assembly according to the invention.

A first preferred embodiment of the vehicle according to the invention in the form of a railway vehicle 101 will be described below with reference to FIGS. 1 to 3.

The vehicle 101 comprises a wagon body 102 which is supported in the region of its two ends on a running gear, respectively, in the form of a bogie 103. However, it is understood that the present invention can also be used in conjunction with other configurations in which the wagon body is supported on only one running gear.

For a better understanding of the following description a vehicle coordinate system x,y,z, (predefined by the wheel contact plane of the bogie 103) is provided in the figures, in which the x coordinate denotes the longitudinal direction of the railway vehicle 101, the y coordinate the transverse direction of the railway vehicle 101 and the z coordinate the height direction of the railway vehicle 101.

The bogie 103 comprises two wheel units in the form of wheelsets 103.1, 103.2 on which a bogie frame 103.4 is supported by a primary suspension 103.3 in each case. The wagon body 102 is in turn supported on the bogie frame 103.4 by a secondary suspension 103.5. The primary suspension 103.3 and the secondary suspension 103.5 are shown simplified in FIG. 1 as helical springs. However, it is understood that the primary suspension 103.3 and the secondary suspension 103.5 can be any desired, suitable spring device, as will be described in detail below in connection with the secondary suspension 103.5.

Figure 2:
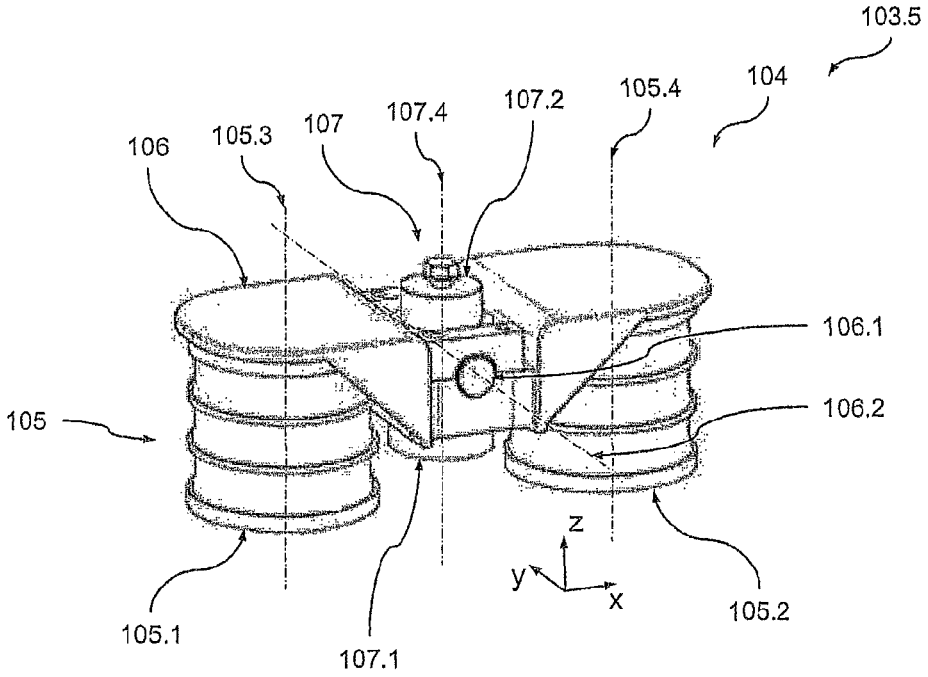
Figure 3:
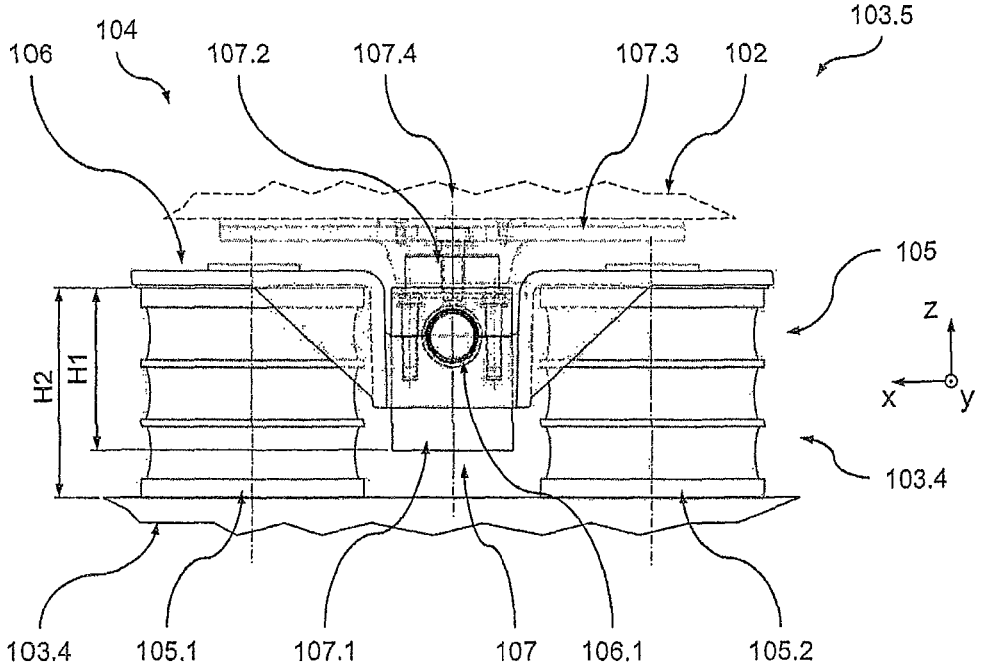

FIGS. 2 and 3 show a perspective view and a side view, respectively, of a preferred embodiment of the spring assembly 104 according to the invention which forms a component of the secondary suspension 103.5. The spring assembly 104 forms one half of the secondary suspension 103.5 via which the wagon body 102 is supported on the bogie frame 103.4 in an direction of action of the spring assembly 104 running parallel to the vehicle height direction (z direction). The spring assembly 104 is arranged in a sufficiently known manner in the region of one of the two lateral sides of the wagon body 102. A further spring assembly 104, which forms the other half of the secondary suspension 103.5, is located on the other lateral side of the wagon body spaced apart in the transverse direction of the vehicle (y direction).

As may be seen from FIGS. 2 and 3, the spring assembly 104 comprises a spring device 105 having a first spring unit 105.1 and a second spring unit 105.2 which are arranged to be spaced apart from each other in the vehicle longitudinal direction (x direction) and are secured with their bottom side to the bogie frame 103.4. The longitudinal axes 105.3 and 105.4 of the two spring units 105.1 and 105.2 run substantially parallel to the vehicle height direction in each case in the illustrated neutral position of the vehicle 101 (standing on straight, level track).

In the present example, the spring units 105.1, 105.2 are formed in a sufficiently known manner as what are known as rubber-metal springs. However, it is understood that any other desired spring units may also be used in other variants of the invention. Therefore, a spring unit may also be made, for example, of one or more helical springs. Passive pneumatic springs may optionally also be used. It is also understood that any desired combinations of such springs may of course also be used.

The two spring units 105.1 and 105.2 are connected at their wagon body-side ends by a bridge element 106 which extends in the vehicle longitudinal direction. In the middle of the interspace between the two spring units 105.1 and 105.2 the bridge element 106 carries an actuator unit in the form of a hydraulic cylinder 107.1 which is a component of an actuator device 107 of the spring assembly 104. The free end of the piston rod 107.2 of the hydraulic cylinder 107.1 is connected to a console 107.3 on which the wagon body 102 or a sufficiently known cradle sits, which in turn supports the wagon body.

Consequently, the spring device 105 and the actuator device 107, in the design according to the invention, are connected in a coupling region by a coupling device in the form of a bridge element 106, such that they act in a kinematically serial arrangement between the bogie frame 103.4 (as a component of the bogie 103) and the wagon body 102.

The longitudinal axes 105.3 and 105.4 of the two spring units 105.1 and 105.2 and the longitudinal axis 107.4 of the hydraulic cylinder 107.1 are arranged so as to be substantially coplanar, such that, in the illustrated neutral position of the vehicle 101, no moments are introduced into the spring assembly 104.

The piston rod 107.3 of the hydraulic cylinder 107.1 can be moved along the longitudinal axis 107.4 of the hydraulic cylinder 107.1, whereby the wagon body 102 can be raised or lowered in the vehicle height direction (i.e. in the primary direction of action of the spring assembly 104) to adjust its height level N (i.e. its spacing in the vehicle height direction) to a setpoint value $N_{setpoint}$ above the reference level defined by the top edges of the rail SOK. Substantially step-free access to a platform level, or (with constant loading) to different platform levels, can always be achieved hereby independently of the loading of the vehicle, for example.

This level-controlling raising or lowering of the wagon body 102 takes place controlled by a controller 108 connected to the actuator device 107. The controller 108 receives the current values of a detection variable from a plurality of sensor devices 108.1 for this purpose, the values being representative of the current height level N of the wagon body at this location. These may be any desired detection variables which allow a conclusion about the current height level N with sufficient accuracy.

In the present example, the sensor devices are contactlessly operating sensors 108.1 (for example ultrasonic sensors) from the measuring signals of which the spacing between the wagon body 102 and the bogie frame 103.4 can be determined. However, it is understood that in other variants of the invention other distance meters, for example mechanical distance meters or the like, may also be used.

The controller 108 controls the supply of hydraulic oil to the hydraulic cylinders 107.1 as a function of the measuring signals from sensors 108.1 to adjust a certain predeterminable height level $N_{setpoint}$ generally or in the case of specific operating states of the vehicle 101 (for example when stopping at a platform or the like).

It is understood that, when controlling the height level N, other variables may also be taken into account. Thus, for example, the wear on the wheels of the wheelsets 103.1, 103.2 (estimated using the operating time or measured) can be taken into account alongside the current state of the primary suspension. The height level N can of course also be measured directly in other variants of the invention.

The kinematically serial arrangement of the hydraulic cylinder 107.1 with respect to the spring units 105.1, 105.2 has the advantage already mentioned in the introduction that the suspension and damping properties of the spring units 105.1, 105.2 are independent of the state of the hydraulic cylinder 107.1. In particular, a malfunction (for example a blockage or a failure) of the hydraulic cylinder 107.1 does not lead to a change in these properties, so the properties of the vehicle crucially affected hereby remain (at least almost) unchanged with regard to travelling safety and passenger comfort.

These properties of the spring assembly 104 (in particular its stiffness in the three spatial directions and primarily the stiffness in the vehicle height direction and the transverse direction of the vehicle) can also be simply adjusted by suitable choice of the parameters of the spring units 105.1, 105.2 and independently of the design of the actuator device 106.

As may be seen from FIGS. 2 and 3, the spring device 105 and the actuator device 106 are arranged in such a way that the installation spaces which they take up overlap in the direction of action of the spring assembly 104 (z direction) in an overlapping region, the region having a first dimension H1 in the direction of action. Despite the kinematically serial arrangement of the hydraulic cylinder 107.1 with respect to the spring units 105.1, 105.2 in the direction of action, a particularly compact design is achieved due to this overlapping of the installation spaces (hence, due to the nested arrangement of the spring device 105 and the actuator device 106).

In the present example, the spring device 105, in the nominal operating state shown in FIG. 3 (vehicle 101 on a straight, level track with nominal load), has a second dimension H2 in the direction of action. In the present example, the first dimension H1 is 78% of the second dimension H2, so high overlapping and therewith an extremely compact arrangement are achieved.

As may be seen from FIGS. 2 and 3, the hydraulic cylinder 107.1 is secured in a decoupling region by a decoupling device in the form of a pivot joint 106.1 to the bridge element 106. The pivot joint 106.1 defines a decoupling axis in the form of a pivot axis 106.2 which, in the illustrated example (in the nominal operating state), runs perpendicular to the spring axis plane defined by the two spring axes 105.3, 105.4 and, therewith, parallel to the transverse direction of the vehicle (y direction).

A decoupling of moments about an axis running in the transverse direction of the vehicle is achieved hereby which, owing to the comparatively large distance between the bogies 103, is advantageous during travel over crests or through depressions because, without this decoupling, significant pitching moments (about a pitch axis running parallel to the transverse axis of the vehicle) would otherwise act on the spring suspension 104 which could result in problems in relation to excessive loading of the piston rod 107.2 and its guide.

In the present example, the pivot joint 106.1 is implemented by two lateral shaft stubs on the housing of the hydraulic cylinder 107.1 which are pivotably located in the bridge element in corresponding bearing shells. However, it is understood that, in other variants of the invention, any other desired design may be implemented for a mechanical pivot joint.

A further decoupling about an axis parallel to the vehicle longitudinal direction is not provided in the present example since the moments that occur about this axis are significantly lower than the pitching moments and can therefore be readily absorbed by the hydraulic cylinder 107.1. However, it is understood that in other variants of the invention a further decoupling of this kind may be provided. By way of example, a cardan link of the hydraulic cylinder to the bridge element may be provided.

Second Embodiment

Figure 4:
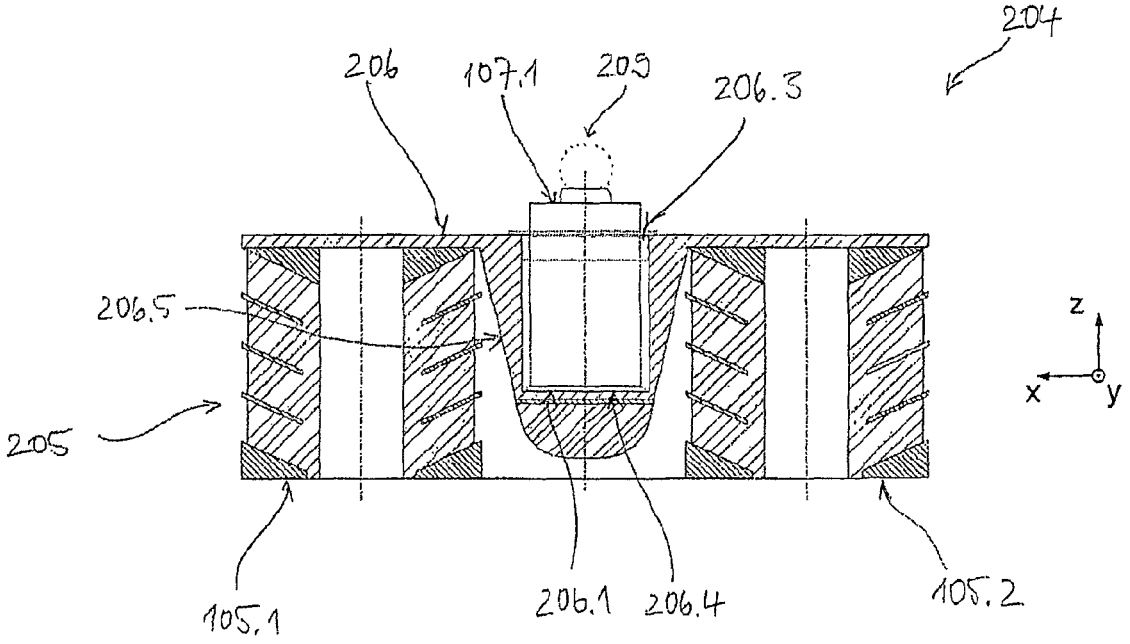

FIG. 4 shows a further advantageous embodiment of the spring assembly 204 according to the invention, which can be used in the vehicle 101 from FIG. 1 instead of the spring assembly 104. In its basic design and mode of operation the spring assembly 204 corresponds to the spring assembly 104 from FIGS. 2 and 3, so only the differences shall be discussed here. In particular, identical components are provided with identical reference numerals while similar components are provided with reference numerals increased by the value 100. Unless stated otherwise in the following, reference is made to the above statements in connection with the first embodiment in relation to the features, functions and advantages of these components.

The difference to the embodiment in FIGS. 2 and 3 lies in the design of the coupling device 206. While this is also implemented as a bridge element 206 between the two springs 105.1 and 105.2, in contrast to the spring assembly 104, in the spring assembly 204 the joint device 206.1 is implemented by a plurality of resilient elements in the form of rubber elements, namely an elastic sleeve 206.3 and a resilient support 206.4 by which the hydraulic cylinder 107.1 is resiliently secured in a coupling region in a bowl-like recess 206.5 of the bridge element 206. This resilient securing brings about a more or less strong decoupling of moments about both the transverse axis of the vehicle and the longitudinal axis of the vehicle depending on the stiffness of the rubber elements.

For the case where this decoupling is not sufficient a further decoupling device may be provided by way of example in the region of the connection of the hydraulic cylinder 107.1 to the wagon body (in a region spaced apart from the coupling region in the force flow direction therefore), as is indicated in FIG. 4 by the broken-line contour 209. This additional decoupling device 209 can also provide a decoupling about one or a plurality of decoupling axes. In particular it may be designed in the manner of a ball and socket joint or a cardan joint. In this case, a substantially rigid connection can then be chosen between the bridge element and the hydraulic cylinder in certain variants of the invention.

Third Embodiment

Figure 5:
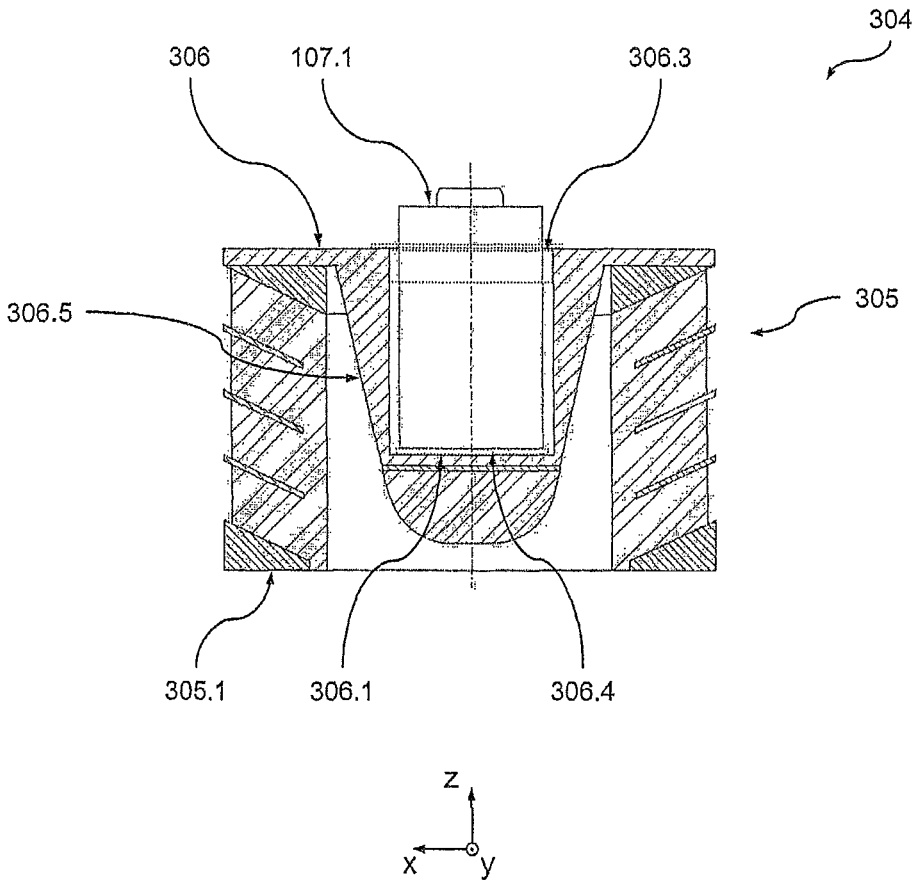

FIG. 5 shows a further advantageous embodiment of the spring assembly 304 according to the invention which can be used in the vehicle 101 from FIG. 1 instead of the spring assembly 104. In its basic design and mode of operation the spring assembly 304 corresponds to the spring assembly 104 from FIGS. 2 and 3 and the spring assembly 204 from FIG. 4, so only the differences shall be discussed here. In particular, identical components are provided with identical reference numerals while similar components are provided with reference numerals increased by the value 100 or 200. Unless stated otherwise reference is made to the above statements in connection with the first and second embodiments in relation to the features, functions and advantages of these components.

The difference from the embodiment in FIG. 4 lies in the design of the spring device 305 and the coupling device 306. So, the spring device 305 comprises just a single spring unit in the form of a rubber-metal spring 305.1 in the interior of which the hydraulic cylinder 107.1 is arranged so as to be nested. The hydraulic cylinder 107.1 sits in a bowl-like recess 306.5 of the coupling element 306 which is connected to the wagon body-side end of the spring 305.1.

As in the spring assembly 204, the joint device 306.1 in the spring assembly 304 is implemented by a plurality of resilient elements in the form of rubber elements, namely a resilient sleeve 306.3 and a resilient support 306.4 by which the hydraulic cylinder 107.1 is resiliently secured in the recess 306.5 of the coupling element 306.

The present invention has been described above solely with reference to examples in which the spring device (located at one end of the spring assembly) sits on a component of the running gear, while the actuator device (located at the other end of the spring assembly) is connected to the wagon body. However, it is understood that in other variants of the invention a reverse arrangement may also be provided in which the actuator device sits on a component of the running gear while the spring device is connected to the wagon body.

The present invention has been described above solely with reference to examples for railway vehicles. It is also understood that the invention may also be used in connection with any other desired vehicles.

The invention claimed is:

1. A spring assembly for level controlled support of a wagon body on a running gear of a vehicle, in particular of a railway vehicle, comprising a spring device which comprises at least one spring unit and an actuator device which comprises at least one actuator unit, wherein the spring device takes up a first installation space, the actuator device takes up a second installation space, the spring device and the actuator device are connected to each other in a direction of action in a kinematically serial arrangement, the actuator device is designed for at least partially compensating for a change in length of the spring device in the direction of action by a displacement at an actuator component in the direction of action, the first installation space and the second installation space overlap each other in the direction of action in an overlapping region, the at least one spring unit and the at least one actuator unit are arranged so as to be nested in each other to produce the overlapping region, the actuator unit is connected by at least one coupling device to the spring device, the at least one coupling device comprises at least one joint device via which the actuator unit is connected to the spring device so as to be pivotable about at least one decoupling axis, and the at least one decoupling axis is arranged in a plane running transversely, in particular perpendicularly, to the direction of action.

2. The spring assembly according to claim 1, wherein the overlapping region has a first dimension in the direction of action, the spring device, in a nominal operating state, has a second dimension in the direction of action, and the first dimension is at least 20% of the second dimension, preferably at least 40% of the second dimension, more preferably at least 60% of the second dimension.

3. The spring assembly according to claim 1, wherein the spring device comprises at least two spring units, the actuator device comprises at least one actuator unit, and the actuator unit is arranged in an interspace between the at least two spring units to produce the overlapping region.

4. The spring assembly according to claim 3, wherein
the actuator unit is connected by at least one coupling device to the spring device,
the coupling device comprises a bridge element,
the bridge element, at a first end, is connected to a first spring unit of the spring device and, at a second end, is connected to a second spring unit of the spring device,
the bridge element comprises a middle region which bridges an interspace between the first spring unit and the second spring unit, and
the actuator unit is connected in the middle region to the bridge element.

5. The spring assembly according to claim 4, wherein
the first spring unit defines a first spring axis,
the second spring unit defines a second spring axis,
the first spring axis and the second spring axis define a spring axis plane, and
the at least one decoupling axis of the coupling device runs transversely, in particular perpendicularly, to the spring axis plane.

6. The spring assembly according to claim 1, wherein
at least one decoupling region with a decoupling device is provided in the region of the actuator device, and
the decoupling device provides at least one moment decoupling about at least one moment axis running transversely to the direction of action.

7. The spring assembly according to claim 1, wherein
the actuator device comprises at least one actuator unit working in accordance with a fluidic operating principle, and
the actuator device, in particular, comprises at least one hydraulic actuator unit and/or at least one hydropneumatic actuator unit.

8. A vehicle, in particular railway vehicle, comprising
a wagon body,
a running gear,
a spring assembly according to claim 1, wherein,
for a level controlled support of the wagon body on the running gear, the spring assembly is arranged between the wagon body and a component of the running gear, in particular a running gear frame of the running gear, and/or is arranged between two components of the running gear, and
the wagon body defines a vehicle longitudinal direction, a vehicle transverse direction and a vehicle height direction, and
in at least one decoupling region, the spring assembly comprises a decoupling device which provides a moment decoupling about at least one moment axis running in the transverse direction of the vehicle.

9. The vehicle according to claim 8, further comprising
a controller connected to the actuator device, and a sensor device connected to the controller, is provided, wherein
the sensor device is designed for detecting a current value of a detection variable which is representative of a level of the wagon body in the height direction above a reference value of a track that is currently being travelled, and
the controller is designed for level-controlling actuation of the actuator device as a function of the current value of the detection variable.

10. The vehicle according to claim 8, wherein the spring assembly is a component of a secondary spring device of the vehicle.

11. A spring assembly for level-controlled support of a wagon body on a running gear of a vehicle, in particular of a railway vehicle, comprising
a spring device, and
an actuator device, wherein
the spring device takes up a first installation space,
the actuator device takes up a second installation space,
the spring device and the actuator device are connected to each other in a direction of action in a kinematically serial arrangement,
the actuator device is designed for at least partially compensating for a change in length of the spring device in the direction of action by a displacement at an actuator component in the direction of action,
the first installation space and the second installation space overlap each other in the direction of action in an overlapping region,
at least one decoupling region with a decoupling device is provided in the region of the actuator device,
the decoupling device provides at least one moment decoupling about at least one moment axis running transversely to the direction of action, and
for moment decoupling the decoupling device comprises at least one rubber element, and/or
the spring device and the actuator device are connected to each other in a coupling region and the at least one decoupling region is arranged in a force flow direction so as to be spaced apart, preferably to be remote, from the coupling region, more preferably to be in an end region of the actuator device facing away from the coupling region in the force flow direction.

12. The spring assembly according to claim 11, wherein
the spring device comprises at least one mechanical spring unit, and
the spring unit, in particular, comprises at least one rubber element and/or at least one metal spring.

* * * * *